US005133193A

United States Patent [19]

Wruck et al.

[11] Patent Number: 5,133,193

[45] Date of Patent: Jul. 28, 1992

[54] AIR HANDLING SYSTEM UTILIZING DIRECT EXPANSION COOLING

[75] Inventors: Richard A. Wruck, Mount Prospect; Gideon Shavit, Highland Park, both of Ill.

[73] Assignee: Honeywell Inc., Minneapolis, Minn.

[21] Appl. No.: 770,700

[22] Filed: Oct. 3, 1991

Related U.S. Application Data

[62] Division of Ser. No. 526,857, May 21, 1990, Pat. No. 5,101,659.

[51] Int. Cl.[5] ..... F25D 17/02

[52] U.S. Cl. ..... 62/99; 62/177; 62/181; 62/209; 62/201

[58] Field of Search ..... 62/90, 99, 177, 183, 62/209, 229, 201, 181, 180; 165/30

[56] References Cited

U.S. PATENT DOCUMENTS 3,525,385 8/1970 Libert ..... 165/30

4,446,703 5/1984 Gilbertson ..... 62/183

*Primary Examiner*—Albert J. Makay
*Assistant Examiner*—J. Sollecito
*Attorney, Agent, or Firm*—Robert B. Leonard

[57] ABSTRACT

A system for controlling the operation of an HVAC system which includes a direct expansion coil, a condenser, a pre-cool coil, and a control system. The control system includes a controller and sensors. The controller receives signals indicative of air flow through the direct expansion coil from the sensors, compares the received signal to a stored air flow rate, and disables the compressor if the stored air flow rate is equal to or greater than the stored value. The controller is also adapted to vary air flow into an occupied space for small changes in the cooling load. In addition, the controller can artificially load the compressor during periods of small cooling load by restricting flow of a cooling agent between the cooling tower and the condenser, or by directing warm water from the condenser through the pre-coil coil.

4 Claims, 6 Drawing Sheets

AIR HANDLING SYSTEM UTILIZING DIRECT EXPANSION COOLING

This application is a division of application Ser. No. 07/526,857, filed May 21, 1990, now U.S. Pat. No. 5,101,639.

BACKGROUND OF THE INVENTION

The present invention pertains to heating, ventilating and air conditioning (HVAC) systems in general, and to an air handling unit arrangement in which a direct expansion coil is utilized.

In some buildings, typically high rises, it is common to use one or more small air handling units per floor. These systems have the advantages of being inexpensive to purchase and install and a self-contained system may be provided for each tenant. For example, each floor of a high-rise building may therefore have one or more small air handling units.

Such systems are characterized by recurring problems related to equipment failure and occupant discomfort. The recurring equipment problems can be identified as being related to icing of the expansion coil and cooling compressor seizure.

The occupant discomfort problems typically are associated with wide variations in temperature due to compressor cycling and excessive removal of moisture from the air.

SUMMARY OF THE INVENTION

In accordance with the invention the foregoing and other problems associated with air handling systems are advantageously solved in an improved method and apparatus.

In accordance with one aspect of the invention, predictive algorithms are employed in a controller to avoid icing of the cooling coil, avoid compressor seizure by eliminating the possibility for certain modes of compressor operation from occurring and to maintain occupant comfort levels.

Another aspect of the invention is the control of variable air volume boxes by the controller in order to improve the comfort level in an occupied space. The controller, for small changes in space temperature requiring only a small cooling load, is programmed to change the air flow into the space, rather than cycle the compressor.

A further aspect of the present invention is the control of cooling agent flow to the condenser by the controller. For small changes in cooling load requiring only a small portion of cooling capacity, the controller is programmed to increase the load on the compressor by restricting a valve which controls cooling agent flow from a cooling tower to the condenser.

Yet another aspect of the invention is the artificial loading of the compressor by causing warm water leaving the condenser to flow through a pre-cool coil which is upstream in the air flow from the direct expansion coil.

BRIEF DESCRIPTION OF THE DRAWING

The invention will be better understood from a reading of the following detailed description in conjunction with the drawing in which like reference characters designate like drawing elements and in which.

DETAILED DESCRIPTION

Figure 1:
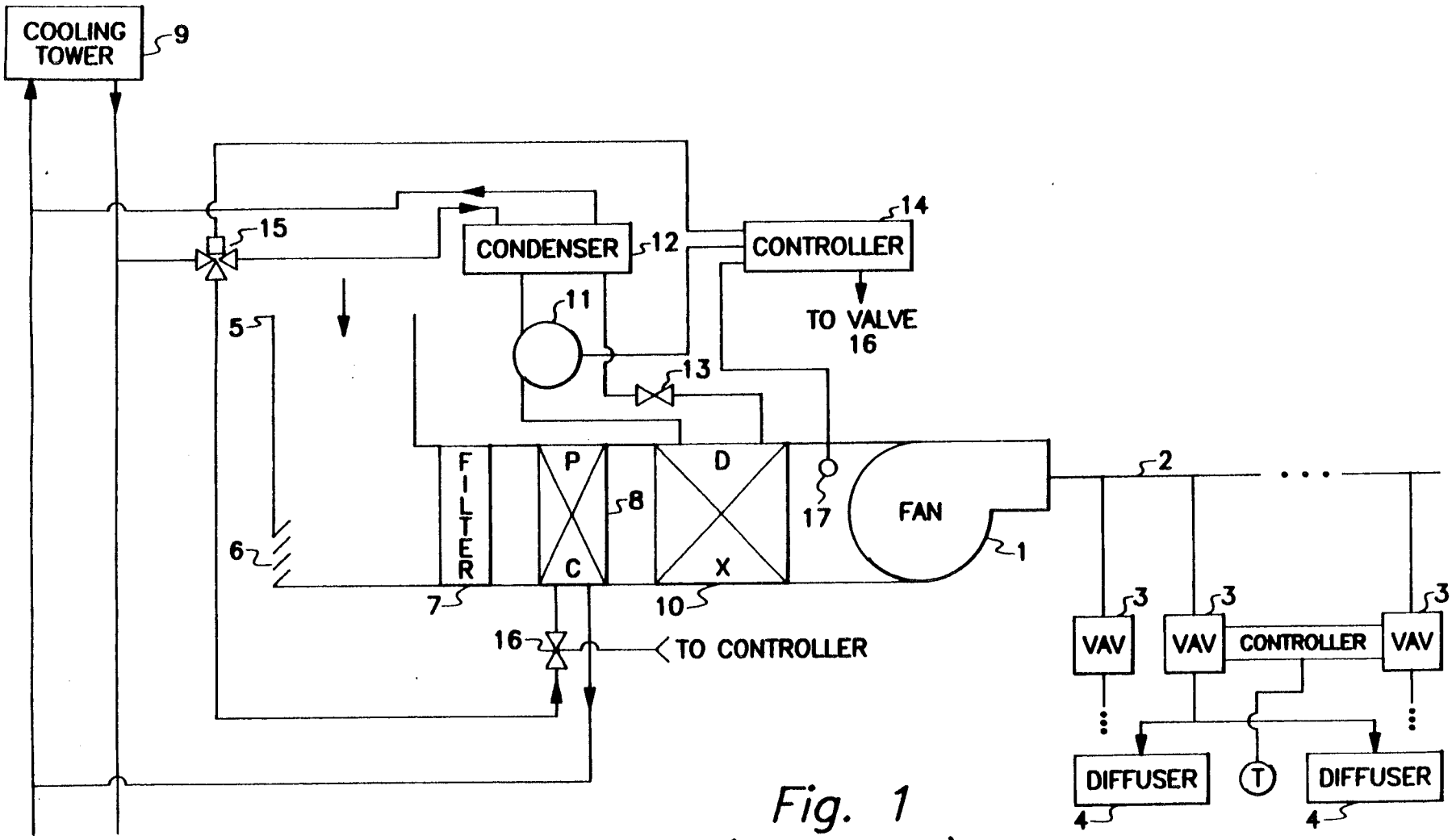
Fig. 1 (Prior Art)
FIG. 1 is a schematic drawing of a conventional air handling system of the type to which the present invention may advantageously be applied.
Figure 2:
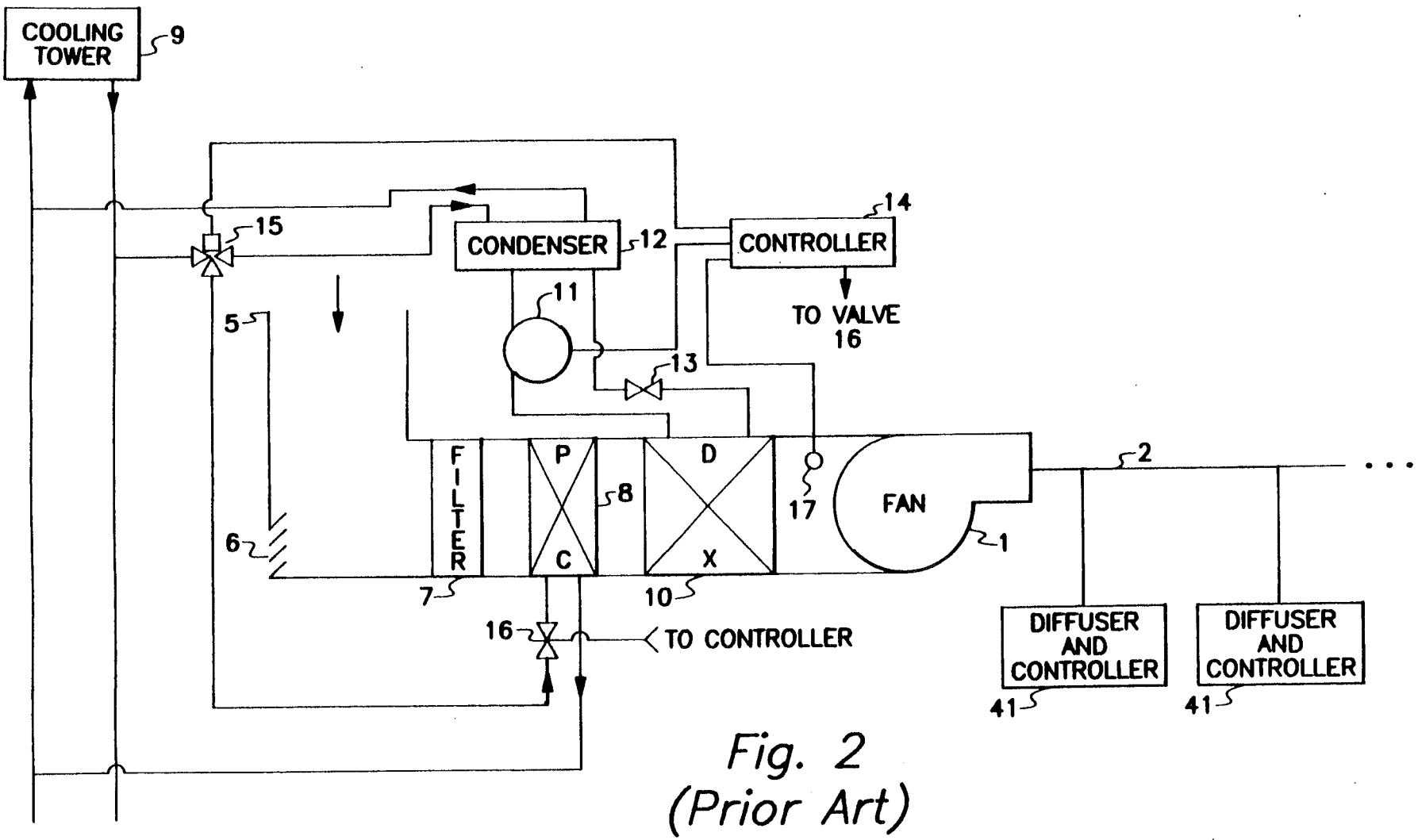
Fig. 2 (Prior Art)
FIG. 2 is a schematic drawing of the system of FIG. 1 illustrating the use of self-contained diffusers.

FIG. 1 illustrates a typical prior art air handling system in which a fan 1 supplies cooled air to a distribution system 2 which may include one or more zone terminals. Each zone terminal may in turn have a variable air volume (VAV) terminal 3 with one or more diffusers 4, or it may have a self-contained diffuser 41, i.e., a diffuser with self-contained controls), as shown in FIG. 2. FIGS. 1 and 2 are identical except for the use of self-contained diffusers in place of VAV's. The following discussion applies equally to FIGS. 1 and 2. Each zone terminal regulates the flow of air into a space to control cooling level and maintain occupant comfort based upon dry bulb temperature in the space.

Air is supplied to the fan primarily by means of return air and a fixed quantity of outside air. The return air flows through return duct 5. Building codes typically require a minimum outside, i.e., fresh air supply. In the illustrative system, the minimum outside air required by building code is supplied via outside air plenum 6.

The air is cleaned by means of filter 7 and passes through a precool coil 8. Precool coil 8 is required under certain building codes for energy conservation and uses cooling water supplied from a cooling tower 9 to provide so called "free cooling" from outside ambient air without the use of a compressor. From precool coil 8, the air flows through a direct expansion coil 10 which is coupled to a compressor 11 via an expansion valve 13. Compressor 11 in turn is coupled to a water cooled condenser 12. Condenser 12 receives a cooling agent, such as cooling water from cooling tower 9.

A controller 14 measures the discharge air temperature from the direct expansion coil 10 via a temperature sensor 17 and controls the output of compressor 11 by cycling compressor 11 on or off. It should be noted that although only one compressor is shown, two or more compressors may be coupled to controller 14. Controller 14 also controls the flow of cooling water to condenser 12 and to coil 8 via three way, two position valve 15 and flow valve 16, respectively.

Condenser 12 contains an internal control valve which monitors the compressor head pressure and varies the water flow to maintain a head pressure set point. The valve opens and closes to maintain the preset compressor head pressure.

Controller 14 is typically an electromechanical controller of a type well known in the art and is of a relatively simple construction, The purpose of controller 14 is to attempt to maintain a constant discharge air temperature, typically 55° F. from the direct expansion coil 10.

In operation, the fan 1 typically runs continuously and either coil 8 or direct expansion coil 10 is used to provide cooling of air. If the cooling water temperature in the supply line from the water tower is at or less than a predetermined temperature, the controller will turn off compressor 11, operate valve 15 to divert water flow from condenser 12 to coil 8 and operate valve 16.

As pointed out briefly above, this prior art arrangement has some significant problems. These problems are icing of the direct expansion coil, compressor seizure or occupant discomfort.

Icing of the direct expansion coil 10 may occur as a result of a low load condition. A direct expansion cooling system is inherently limited in its ability to throttle cooling capacity. Because of this, cooling is limited to discrete capacity steps. As the cooling load drops below the minimum throttling capacity of the cooling stage, icing of the coil 10 occurs.

It has also been determined that loose fan belts or dirty filters can result in icing of the coil 10. In all three cases the air flow through the coil 10 is reduced and the result may be icing.

Additionally, if valves 15 and 16 stay open such that cooling water always flows to coil 8, the load on the direct expansion coil 10 is reduced. If condenser 12 cooling water valve (controlled by head pressure) sticks open, this can lead to compressor failure. This condition will cause excessive compressor cycling due to automatic safety cutouts. A stuck condenser cooling valve can result in the condenser cooled to a lower temperature than the direct expansion coil. These conditions result in oil migration from the compressor, seizure and permanent failure. Valves 15 and/or 16 commonly stick open as a result of scale or dirt build up in the valves resulting from the use of water which flows directly from cooling tower 9.

Compressor failure as evidenced by compressor seizure may result from several causes. If the compressor cycles too often in a given time period, the resulting high pressure differential in the compressor may result in seizure. A controller 14 determines the number of cycles that it will initiate in a given time period as a function of a manual setting. Very often this cycle rate will be increased by maintenance personnel to resolve occupant discomfort. The actual number of cycles may be more than the controller setting A reason for this is if the compressor begins overheating the temperature limit switch in the compressor opens up. This limit switch cycle may repeat multiple times during a single on cycle from controller 14.

Figure 3:
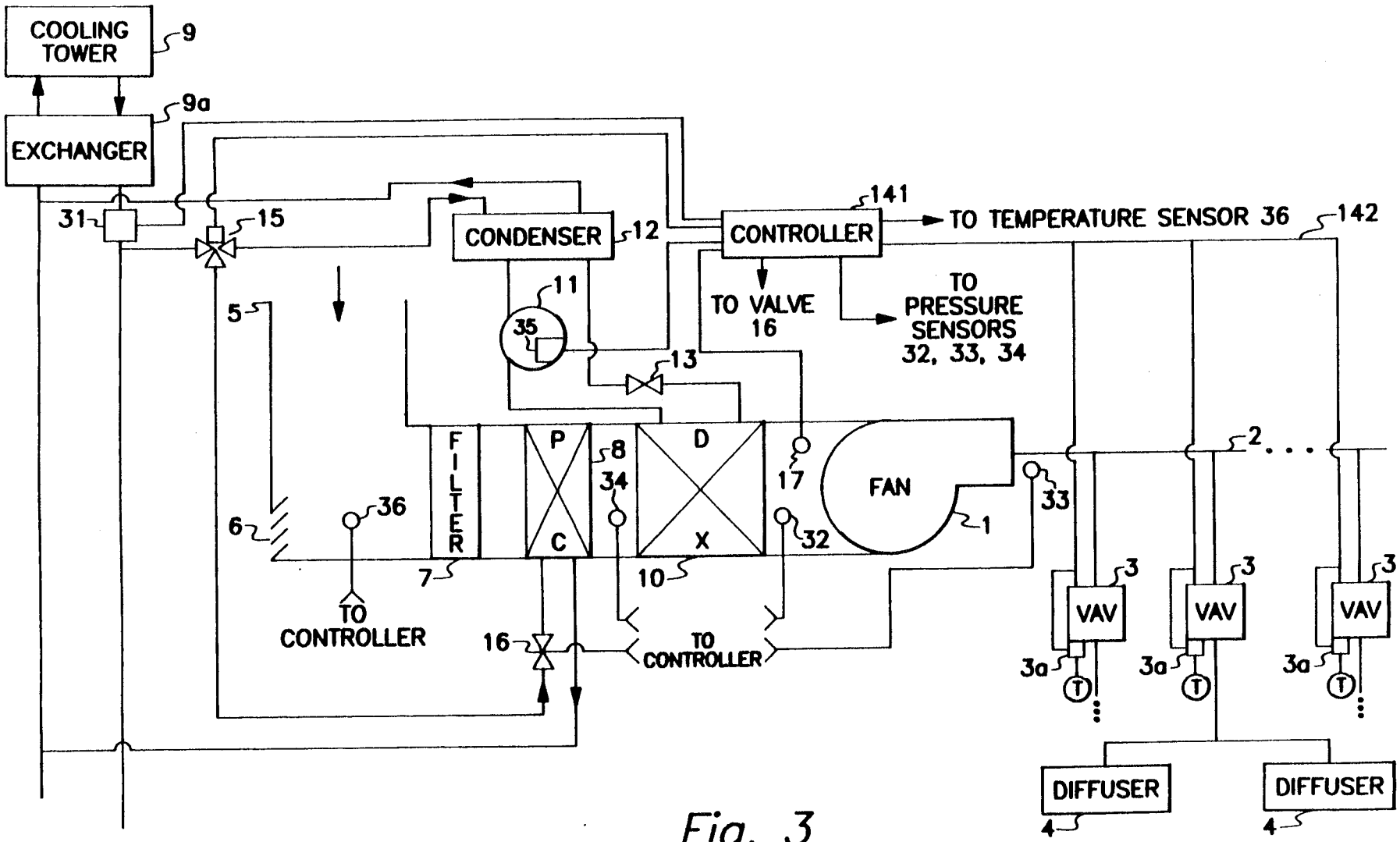
FIG. 3 is a schematic drawing of an improved air handling system in accordance with the present invention.

Turning now to FIG. 3, the improved system in accordance with the invention is shown. In the improved system the cooling water passes through a heat exchanger 9*a*. The heat exchanger protects valves 15 and 16 from dirt and scale. Controller 14 of the prior system is replaced with a programmable controller 141 which will be described in further detail below. A temperature sensor 31 is connected to measure the temperature of the cooling water from the cooling tower. A pressure sensor 32 is provided to measure the air pressure downstream of the direct expansion coil 10. Alternatively, a pressure sensor 33 may be provided downstream of fan 1. Another pressure sensor 34 is provided downstream of the coil 10. In addition, a status sensor 35 is provided at compressor 11. The status sensor may be of any conventional type which would indicate whether the compressor 11 is energized and running or not. The sensors 32, 33 and 34 may be any conventional air pressure sensor. Likewise tower water sensor 31 may be any conventional temperature sensor. Also connected into the controller but not shown is one or more temperature sensors which measure the temperature in the spaces in the building which are to be controlled.

As was noted above, one problem associated with direct expansion cooling based air handling units in the past has been icing of the direct expansion coil. In accordance with the present invention, the coil resistance to air flow is measured. The controller 141 does this by calculating the pressure differential between pressure sensors 34 and 32 or 34 and 33 and determining air flow through the DX using air flow sensor 17. The controller then determines if the DX coil is iced by looking in a look up table stored in memory at an address determined from the air flow. If the pressure drop is greater than the value stored at the selected address, the controller determines that the DX coil is iced. If as a result of that comparison it is determined that the coil is iced, the controller will turn off the compressor and deice the coil. Meanwhile, the controller will continue to measure the pressure on either side of the coil 10 by means of pressure sensors 34 and 32 or 33. When the pressure differential drops to a level which is indicative of a deiced coil, the controller then permits the compressor to be turned on again if cooling is called for.

In addition, the controller can operate to determine whether or not there is a probability that a filter 7 is dirty and needs replacement or if the belt driven fan 1 has a loose belt. In either of those situations reduced air flow occurs which may be sensed by the sensors 32, 34 and 33. Depending upon the signature of the reduced air flow it may be determined whether the air flow reduction is due to a dirty filter, icing of the coil or a loose belt. Under each of those circumstances, the time period over which the air flow reduces will be different. The controller 141 can calculate the time rate of change in the air pressure and compare that time rate of change with data stored in the controller memory to determine whether there is icing of the coil, a loose belt or a dirty filter.

Compressor seizure may occur from excessive cycling. In accordance with the invention the status of the compressor is monitored or measured by means of sensor 35. Sensor 35 can, for example, monitor the current flow to the compressor and thereby determine whether or not the compressor is running. Controller 141 monitors the number of compressor cycles and will not allow the compressor to be activated if the compressor has reached a predetermined upper limit of cycles in a given period of time, i.e., an hour. With this arrangement, should a compressor cycle too many times in an hour, due, for example, to the thermal overload switch being tripped in the compressor, then the controller will not allow a manual override to cause the compressor to be operated. Furthermore, a diagnostic message may be generated by the controller 141 to let the system or building operator know that there is a potential problem.

Controller 141 can also calculate the load imposed on the fan system by utilizing the pressure sensors to measure the air flow and by measuring the temperature differential across the system. By using predictive techniques, increasing the discharge air temperature setpoint will increase the air flow across the direct expansion coil !0. The increased air flow will prevent icing on direct expansion coil 10.

The controller 141 also may be used to maintain the condenser pressure at the lowest allowed level to not only avoid compressor seizure but to provide for energy savings.

Controller 141 also can avoid a change over from use of the precoil 8 to compressor cooling at low loads. If the water temperature as measured by sensor 31 indicates that the temperature of cooling tower water reaches a level at which cooling tower water cannot provide adequate cooling and the compressor only has a relatively low load, then the flow versus temperature difference may be used to maintain a higher level temperature in the controlled space with a higher air flow. In other words, the discharge temperature from the fan would be allowed to float and the compressor would be turned on only when the cooling load is above a predetermined threshold level (e.g. 10–15% of cooling capacity). With this arrangement an intelligent decision is made to try to maintain occupant comfort within a particular comfort band, but if it is needed to save the equipment, the controller 141 will cause the system to operate such that it operates at the higher end of the comfort band. This is of course different than prior art systems in which there was no provision for automatic override of, for example, temperature sensors.

Controller 141 also operates to prevent compressor seizure by artificially loading the compressor during low load conditions. More specifically, under low load conditions, controller 141 may energize valves 15 and 16 such that the precool coil 8 is used as a preheater to increase the load on the compressor under low load conditions. As an additional strategy, controller 141 may use the valve 15 to decrease water flow through the condenser and to increase the new pressure thereby increasing the load on the compressor.

Figure 4:
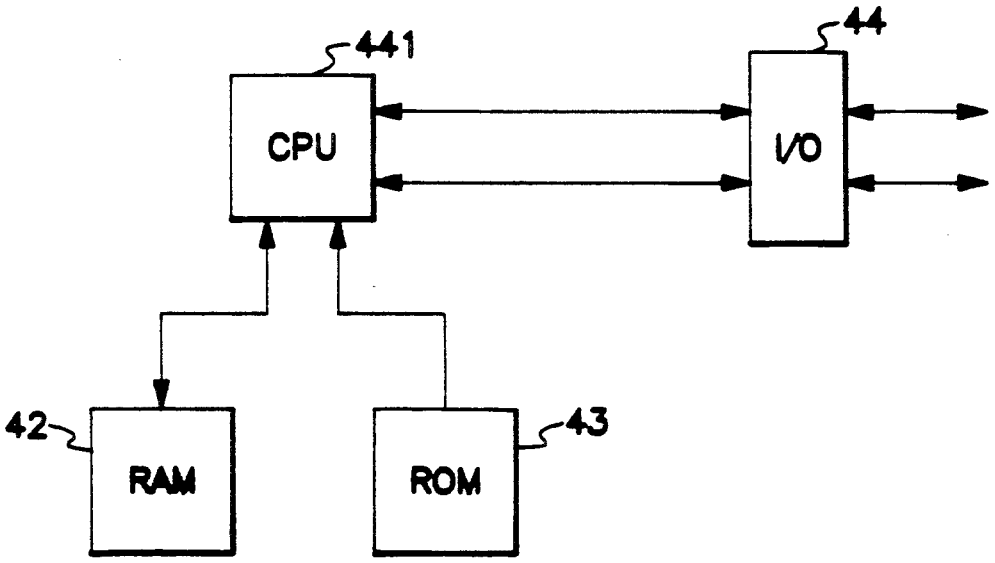
FIG. 4 illustrates in block diagram form a controller of the type which may be advantageously employed in the system of FIG. 3.

Turning now to the aforementioned problem of occupant discomfort, the use of multiple VAV boxes 3*a* eliminates wide variations in temperature by maintaining the manufacturers recommended cycle rate of the compressor as discussed above and by maintaining a cooling load by changing the zone terminal air flow rate as a result of fan discharge air temperature variation. Additionally, occupant discomfort due to dehumidification is minimized by utilizing controller 141 to maintain the proper balance between air flow rate and temperature differential to maintain the smallest temperature difference across the direct expansion coil 10. Turning now to FIG. 4, a representative controller is shown. Controller 141 includes CPU 441 of a type well known in the art, a random access memory (RAM) 42 which may be any conventionally available random access memory, a read only memory (ROM) 43 which contains the various data necessary for operation of the system and an IO or input/output interface 44. The IO interface 44 provides a buffer between the CPU and the various sensors and control points of the system. As is well known, such a device will include circuitry for providing appropriate voltage and/or current interface to the various sensors and to the various control devices such as valves 15 and 16 and for control of the compressor 11. Each and every one of the elements of FIG. 4 is well known. The controller 141 may in its totality be purchased from Honeywell Inc. as Honeywell's MICROCEL system controller.

Occupant discomfort and equipment failures can be traced to the performance of the central fan direct expansion cooling system under low load conditions. The system is inherently limited in its ability to throttle cooling capacity. In addition, cooling air is limited to discrete temperature steps. Low load conditions can result in fan coil icing as the cooling load drops below the minimum throttling capacity of the first cooling stage. Coil icing may lead to compressor failure or simply starve the air flow causing occupant discomfort.

Since direct expansion cooling is a staged process, the central fan discharge air temperature will cycle under less than full load conditions. Conventional VAV zone terminal control loops are not configured to compensate for rapid changes in the cooling supply air temperature. The response of a space temperature control loop is dominated by a time constant on the order of 12 minutes. This sluggish response results in unstable control of the space temperature and occupant discomfort.

Figure 5:
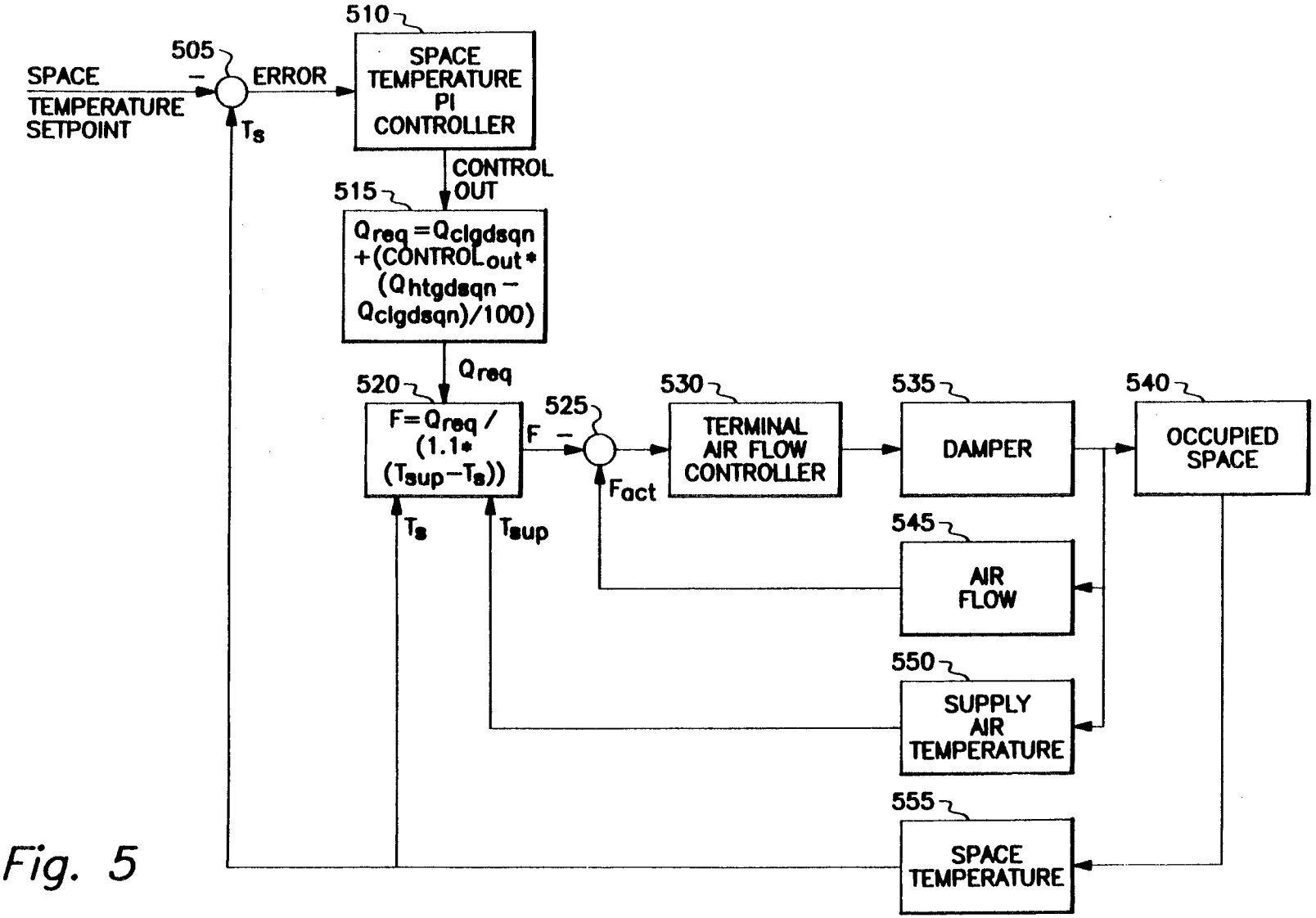
FIG. 5 is a flow diagram of cooling operation.
Figure 6:
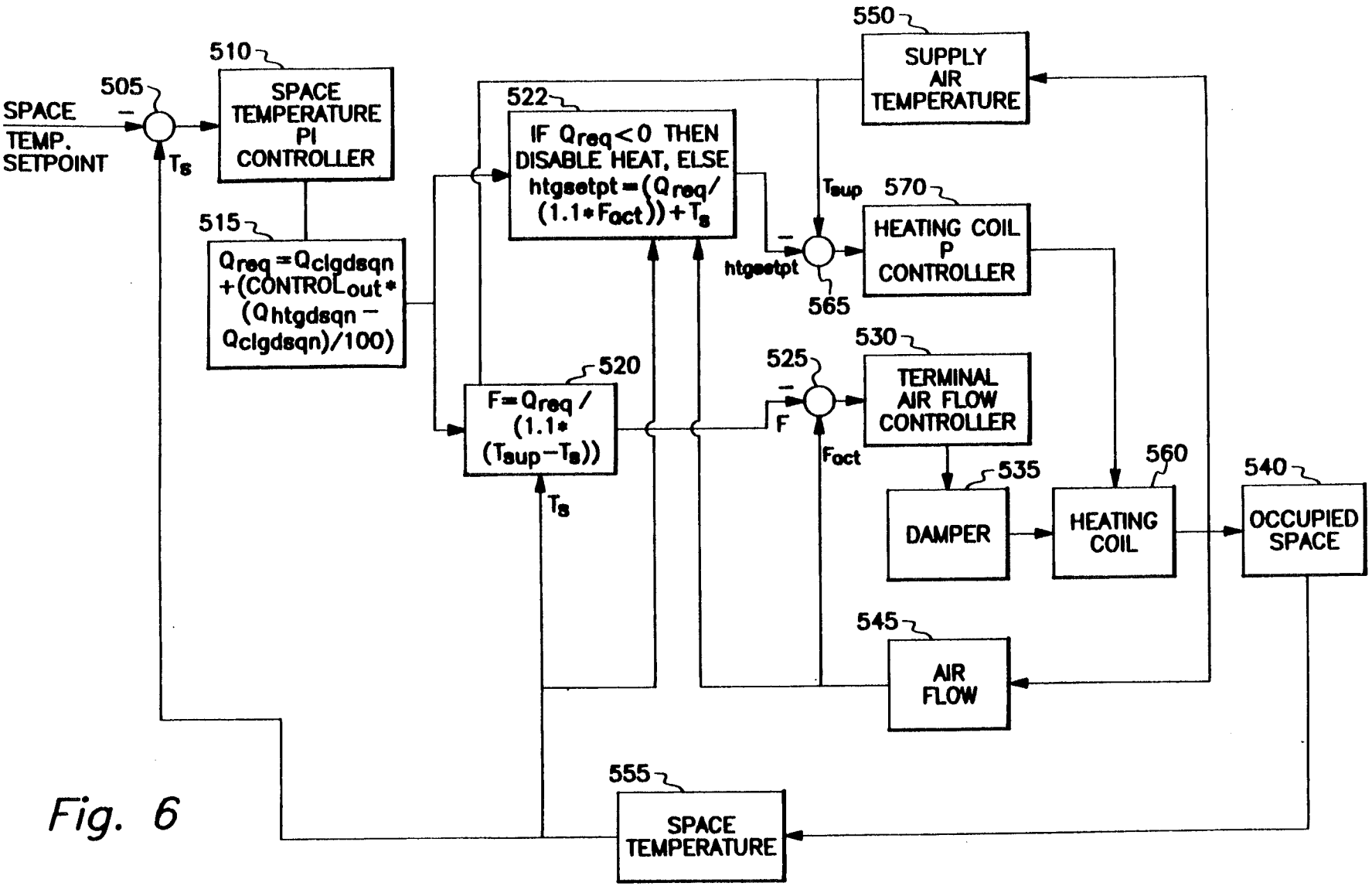
FIG. 6 is a flow diagram heating and cooling operation.

The attached control diagrams shown in FIGS. 5 and 6 describe a zone terminal control which compensates for rapid variations in the central fan supply air temperature. Conventional zone VAV controllers use a similar cascade control loop with the output of the space temperature controller directly resetting the VAV flow control set point. The proposed strategy is different because it incorporates feed forward compensation for disturbances in the cooling air temperature.

A space temperature controller determines the amount of cooling or heating energy required ($Q_{req}$) to maintain a comfortable room temperature. As the space temperature PI controller output varies from 0 to 100, this signal is converted to the space energy required $Q_{req}$ to maintain occupant comfort.

$$Q_{req} = Q_{clgdsgn} + (\text{Control}_{output} * (Q_{htgdsgn} - Q_{clgdsgn})/100$$

where $$\left| \begin{array}{l} Q_{req} \leqq \left| Q_{clgdsgn} \right| \text{cooling mode} \\ Q_{req} \leqq \left| Q_{htgsdgn} \right| \text{heating mode} \end{array} \right.$$

and $Q_{req}$ is the required heat transfer to the conditioned space. $\text{Control}_{out}$ is the output of the space temperature controller.

For zone design cooling load:

$$Q_{clgdsgn} = 1.1\ F_{max}\ (T_{supclg} - T_{spacemax})$$

where: $T_{supclg}$ is the design cooling supply temperature.

$T_{spacemax}$ is the design cooling season space temperature.

Fmax is zone terminal design maximum air flow. For zone design heating load:

$$Q_{htgdsgn} = 1.1\ F_{min} \times (T_{suphtg} - T_{spacemin})$$

where: $T_{suphtg}$ is the design discharge air temperature of the air VAV box reheat coil. $T_{spacemin}$ is the design heating season space temperature.

Fmin is zone terminal design minimum air flow. If the zone terminal is cooling only, $Q_{htgdsgn} = 0$.

The VAV flow controller setpoint is calculated based on the required space heat transfer, current supply air temperature as well as the space temperature.

$$F = Q_{req}/1.1 * (T_{sup} - T_s)$$

where F is the flow set point, $T_{sup}$ is the supply air temperature and $T_s$ is the space temperature.

Variations in the central fan supply air temperature will immediately affect the air flow distributed to the occupied space. An increase in fan supply temperature increases air flow while a decrease results in lower air flow. In all cases, the inner loop will attempt to maintain the space heat transfer dictated by the outer loop space temperature controller. Of course the VAV terminal air flow setpoint range is restricted between the minimum and maximum air flow limits.

Reheat coils located in a VAV terminal are controlled with a calculated heating discharge air temperature setpoint $htg_{setpt}$.

If $Q_{req} < 0$
THEN the $Q_{htgsetpt} = (Q_{req}/1.1*F) + T$
IF $Q_{req} > 0$
THEN heating off Zones installed with heating convectors or radiators may use the $Q_{req}$ signal directly from the space temperature controller.

FIG. 5 and FIG. 6 illustrate the system and controller operation in a flow chart form. FIG. 5 illustrates the control of the VAV's boxes 3 in FIG. 3 for cooling only whereas FIG. 6 illustrates the flow control for heating and cooling with zone VAV's.

In FIG. 5, summer 505 creates an error signal as the difference between a user selected space temperature setpoint and the actual space temperature ($T_s$) signal produced by space temperature sensor 55. This error signal is then provided to a space temperature PI controller 510. The PI controller in turn produces a $control_{out}$ signal which is based on a first fraction of the error signal and a second fraction of the integral of the error signal. PI controllers are well known in the art, as are the methods of selecting the first and second fractions depending upon the control desired.

Once the $Control_{out}Q$ signal has been determined, the required heat transfer, $Q_{req}$ must be calculated, as shown in box 515. Once the $Q_{req}$ is calculated, the required air flow, $F_1$ into the space being controlled can be determined, as shown in box 520. Since F is dependent upon the space temperature $T_s$ and the supply air temperature $T_{sup}$, block 520 is shown as receiving $T_s$ and $T_{sup}$ from space temperature sensor 555 and supply air temperature sensor 550. Once F is calculated, it is compared with actual flow ($F_{act}$) signal produced by air flow sensor 545. The difference is calculated by summer 525 and provided to terminal controller 530. Note that summers 505 and 525, PI controller 510 and blocks 515 and 520 are all parts of controller 3*a*.

Terminal controller 530 in turn responds to the difference signal provided to it. It also is a PI controller which operates in a manner similar to space temperature controller 510. Terminal controller produces a flow control signal which is then sent to damper 535. Damper 535 controls the amount of air flow into occupied space 540.

As we stated earlier, the system shown in FIG. 6 is basically the same as the system shown in FIG. 5, except that the system shown now includes elements so that a space can be heated as well as cooled. Block 520' now has two algorithms, one for heating and one for cooling. The heating algorithm is elected when $Q_{req}>0$ and the cooling algorithms is selected when $Q_{req}<0$. Note that for convenience, supply air temperature sensor 550 is shown twice although only one sensor is used.

Turning now to FIG. 6, four new parts have been added to the system of FIG. 5 so that heating may be accomplished. Block 522 creates a heating setpoint signal as a function of $Q_{req}$, $F_{act}$ and $T_s$. Summer 565 then adds $T_{sup}$ and heating setpoint to create a heating error signal. Both blocks 522 and summer 565 are additional blocks of controller 141 in a system which can heat as well as cool.

The heating error signal is then provided to a heating P controller. The heating P controller multiplies the error signal by a predetermined fraction to produce a heating control signal for heating coil 560. Heating coil 560 in turn heats up air passing through the damper into the occupied space.

In all other aspects, the system shown in FIG. 6 is the same as the system of FIG. 5.

The foregoing has been a description of a novel and non-obvious control system for HVAC systems. The embodiments described herein are not intended to limit the scope of the inventors property rights as defined by the appended claims.

We claim:

1. A method of reducing wear of a compressor and an HVAC system which also includes a water tower which produces cooled cooling agent, a condenser which produces both cooled and warmed cooling agent, a precool coil, a variable rate valve for controlling the source and volume of cooling agent for the precool coil, a compressor, a direct expansion coil operably connected to the compressor and a programmable controller adapted to control the operation of the compressor and the variable flow rate valve, comprising the steps of:

determining an air flow rate for air flowing through the precool coil;

determining a cooling water temperature for cooling water leaving the cooling tower;

determining a current temperature for the space;

selecting a desired temperature for the space;

calculating a current cooling load as a function of the current temperature and the desire temperature;

calculating a cooling ability of the precool coil as a function of said cooling water temperature and said air flow rates;

comparing the cooling ability of the precool coil with the cooling loads; and operating the compressor if the cooling load exceeds the cooling ability.

2. The method of claim 1, comprising the further steps of:

calculating a percentage of cooling capacity required by dividing said cooling load by said cooling capacity; and loading the compressor artificially if said percentage is less than a predetermined percentage.

3. The method of claim 2 wherein;

loading the compressor artificially is accomplished by switching the valve so that the warmed water from the condenser is directed through the precool coil.

4. The method of claim 2, wherein:

loading the compressor artificially is accomplished by restricting cooling agent flow through the variable flow rate valve.

* * * * *